US005791736A

United States Patent [19]

Herbert

[11] Patent Number: 5,791,736

[45] Date of Patent: Aug. 11, 1998

[54] ERGONOMIC SEATING APPARATUS WITH INCLINED FEMORAL PORTION

[75] Inventor: Jeffrey J. Herbert, Heidelberg, Australia

[73] Assignee: Heygarth South Pty. Ltd., Heidelberg, Australia

[21] Appl. No.: 604,994

[22] PCT Filed: Aug. 31, 1994

[86] PCT No.: PCT/AU94/00513

§ 371 Date: Feb. 29, 1996

§ 102(e) Date: Feb. 29, 1996

[87] PCT Pub. No.: WO95/06424

PCT Pub. Date: Mar. 9, 1995

[30] Foreign Application Priority Data

Aug. 31, 1993 [AU] Australia ..... PM0920
Oct. 20, 1993 [AU] Australia ..... PM1909

[51] Int. Cl.[6] ..... A47C 7/02

[52] U.S. Cl. ..... 297/452.21; 297/452.27; 297/DIG. 1; 5/653

[58] Field of Search ..... 297/452.21, 452.27, 297/DIG. 1; 5/653, 654, 740, 909

[56] References Cited

U.S. PATENT DOCUMENTS

| | | | |
|---|---|---|---|
| 3,305,878 | 2/1967 | Hellbaum | 5/653 |
| 3,308,491 | 3/1967 | Spence | 297/DIG. 1 X |
| 4,668,015 | 5/1987 | Kjersen | 297/452.21 |
| 4,690,459 | 9/1987 | Ullman | 297/458 |
| 4,755,411 | 7/1988 | Wing et al. | 297/452.27 X |

FOREIGN PATENT DOCUMENTS

| | | | |
|---|---|---|---|
| 73415/87 | 5/1986 | Australia . | |
| 1115421 | 10/1961 | Germany | 297/452.21 |
| 558158 | 12/1974 | Switzerland . | |
| 991196 | 5/1965 | United Kingdom | 297/452.27 |
| 2 006 618 | 5/1979 | United Kingdom . | |
| 86/07528 | 12/1986 | WIPO . | |
| 91/03969 | 4/1991 | WIPO . | |
| 92/15232 | 9/1992 | WIPO . | |

*Primary Examiner*—Laurie K. Cranmer
*Attorney, Agent, or Firm*—Jacobson, Price, Holman & Stern, PLLC

[57] ABSTRACT

A seat having a base and a seating section. The seat section has an upwardly inclined portion, a substantially horizontal portion and an inclined support portion. The inclined portion supports the femurs of a person so that the femurs and knees are supported in a position below the person's acetabulum, the horizontal portion receives and holds the ischial bones and the inclined portion supports a person's gluteal muscles and sacro-illiac ligaments. The seat has a backrest to support a person between the second and third lumbar vertebrae when a person is seated on the apparatus. The backrest has a support surface which is positioned between the rear of the seat and the first intermediate positions so that the person's gluteal muscles can extend behind the support surface between the rear of the seat portion and the support surface of the backrest.

29 Claims, 3 Drawing Sheets

20
25
R
34 B
40
23
32 A
33
33b 35
42
39
21
30
F
θ1
24
33a
22
26
28
θ2
θ3
12

ERGONOMIC SEATING APPARATUS WITH INCLINED FEMORAL PORTION

This invention relates to a seat such as a chair but also includes any other seating apparatus such as sofas, couches, stools and the like.

Many attempts have been made to produce seating which places a person in a position so that the pelvis, sacrum, spinal column and cranium are in correct biomechanical and organic orientation and physiologically efficient posture.

It is well recognised and documented that incorrect seating posture causes incorrect biomechanical and organic orientation of the pelvis, sacrum, spinal column and cranium which in turn creates significant central and peripheral nervous system distortions and interferences, which creates musculo-skeletal dysfunction which translates to health, well-being and efficiency problems.

As is well know and documented, a person's nervous system controls and co-ordinates all organic and biomechanical functions of the body.

The brain being the master control is housed in the cranium which is made up of several bony plates that are functionally movable. From the brain stem forms the spinal cord made up of tracks which carry sensory and motor function information to control and co-ordinate all bodily biomechanical and organic function. The individual vertebral spinal nerves are formed by the union of ventral and dorsal spinal nerve roots which are extensions of the spinal cord. The spinal nerves extend in pairs outwardly from the spinal cord between the vertebrae of the spinal column, sacrum and pelvis to the various organs and tissues of the body.

It has long been recognised that incorrect seating posture can cause incorrect biomechanical and organic orientation of the pelvis, sacrum, spinal column and cranium, which applies pressure and tension on the brain tissue, spinal cord and spinal nerve roots which in turn result in altered and improper neural control of the various organs and tissues of the body. This in turn can result in damage and/or disease to those organs and tissues.

Many attempts have been made to produce seating which maintains the spine straight and these include seats which places a person in a generally kneeling position as well as other seating apparatus which is intended to provide lumbar support and also maintain the spine in its correct configuration.

These seats may provide some improvement to the seating attitude and may maintain the spine in a more preferred configuration.

However, this seating configuration still forces and/or requires a person to sit firmly on the sacrum, coccyx and ischial tuberosities as a triangular configuration thereby constraining the sacroiliac ligaments. Due to this, gravitational forces pulling down all aspects of the pelvic bowl and general inadequate design of seating biomechanics, the sacrum is locked in a fixed position and prevents and inhibits normal vibratory rhythmic movement of the sacrum.

Correct biomechanical and organic orientation of the pelvis, sacrum, spinal column and cranium is not only important to enable the nervous system to operate optimally, efficiently and correctly but also to provide proper primary respiration.

Primary respiration is defined for the purposes of this specification to be the proper hydrostatic pressure and circulation of the cerebrospinal fluid (CSF) and tone of neural tissue.

Inside the brain are holes called ventricals. Lining these ventricals are specialised cells called the choroid plexus.

These cells produce approximately 750 mls of CSF per day. This fluid exits the brain at specific holes into the external areas around the brain.

Around the brain and spinal cord are three layers of cells called the dura mater, arachnoid mater and pia mater from external to internal respectively.

The CSF exits foramina (holes) in the base of the brain into the space created between the pia mater and arachnoid mater called the arachnoid space.

This space is a closed system and extends around the brain down to and connects with the second sacral tubercle of the internal aspect of the sacrum in the spinal canal.

This closed system has a specific hydrostatic pressure that must be maintained for neural function to be normal and optimal. Also the CSF fluid must flow properly around the brain and spinal cord to properly hydrate, cleanse and flush the system of neural cell waste and it also transports pituitary hormones to the external venous system through the specific villi.

Pressure and circulation of the spinal fluid is caused by movement of the cellular contractibility of the brain tissue and vascular and respiratory forces. These movements and forces cause the cranium, intercranial membranes and sacrum to move in an expansion and contraction movement called flexion and extension. This movement creates a detectable third wave which is the pressure and flow movement of the CSF through the cranium and spinal column.

Since natural movement of the sacrum is at least partly responsible for circulation and hydrostatic pressure of the spinal fluid, locking of the sacrum so that it cannot move when a person is placed, seated or forced in an incorrect biomechanical and organic orientation this position will impair primary respiration which means that hydrostatic pressure and flow of the spinal fluid will be impaired.

Lack of proper pressure and circulation and the resultant impaired operation of primary respiratory system adversely effects nervous system function which adversely effects neural control of the organs and tissues of the body. This nervous system dysfunction is outwardly manifested or shown by organic and biomechanical dysfunction.

The object of this invention is to provide a seating apparatus which overcome the above problems.

The invention may be said to reside in a seating apparatus including:

a seat portion for connection to a base so that the seating apparatus can be supported on the ground, said seat portion having a front and a rear;

said seat portion having;

(a) an upwardly inclined portion which inclines upwardly from the front of the seat portion to a first intermediate position between the front and rear of the seat portion;

(b) a substantially horizontal portion extending from the first intermediate position to a second intermediate position; and (c) an inclined support portion extending between the second intermediate position and the rear of the seat portion;

wherein the upwardly inclined portion is for supporting the femurs of a person so that the femurs and knees are supported in a position below the person's acetabulum, said substantially horizontal portion being for receiving and holding the ischial bones when the person sits down and said inclined support portion being for supporting the persons gluteal muscles and sacra-iliac ligaments.

The invention also provides a seating apparatus including:

a seat portion for connection to a base so that the seating apparatus can be supported on the ground, said seat portion having a front and a rear;

said seat portion having;

(a) an upwardly inclined portion which inclines upwardly from the front of the seat portion to a first intermediate position between the front and rear of the seat portion;

(b) an inclined support portion extending between a second intermediate position and the rear of the seat portion;

(c) a substantially horizontal portion between the first intermediate position to the second intermediate position;

wherein the upwardly inclined portion is for supporting the femurs of a person so that the femurs and knees are supported in a position below the person's acetabulum, said substantially horizontal portion being for receiving and holding the ischial bones when the person sits down and said inclined support portion being for supporting the persons gluteal muscles and sacra-iliac ligaments;

the upwardly inclined portion including a first cushioning material;

the horizontal section including a second cushioning material; and the first cushioning material being denser than the second cushioning material so that when a person sits on the seating apparatus the second cushioning material is compressed and holds the ischial bones and the first cushioning material which is of higher density than the second cushioning material prevents a person from slipping forward on the seating apparatus.

Since the seating apparatus of the invention receives the ischium and holds the ischium in place and prevents the sacrum from locking, the sacrum, pelvis, spinal column and cranium are able to move normally with vascular and respiratory forces to ensure that the primary respiratory system operates correctly. Furthermore, since the sacrum, pelvis, spinal column and cranium are free to move the spine remains in its correct biomechanical and organic orientation to ensure that pressure and tension are not applied to spinal nerves by incorrect biomechanical and organic orientation of the spine. Thus, not only is the spine maintained in a correct position which does not place distortion or interferences on the nervous system but also this enables the nervous system to operate efficiently to its full potential and primary respiratory system also to operate efficiently to its full potential.

Correct seating is not only a question of comfort, it is a precondition for occupant well-being and efficiency. Since many people are seated for a long period of time, a seating posture which provides correct biomechanical and organic orientation provided by the seating apparatus of this invention thereby ensure that the health and well-being and efficiency is maintained at peak levels and is not impaired or deteriorated or interfered with by incorrect seating biomechanical and organic orientation.

Preferably the upwardly inclined portion is inclined at an angle of between 30° and 50° with respect to the horizontal, the substantially horizontal section has a length of between 160 and 180 mms and the inclined support portion is inclined at an angle between 30° and 50° to the horizontal. These preferred dimensions facilitate to keep the spine in the most physiologically efficient posture and correct biomechanical and organic orientation. In particular it will maintain the lumbar curve of a person to be between 30° and 50°, the Ferguson angle in a male between 30° and 45° and in a female between 23° and 40° and the Ferguson perpendicular postural line measuring either one third anterior or one third posterior of the sacral base. By obtaining these specific angles, the most efficient posture and correct biomechanical and organic orientation is obtained which facilitates primary respiration.

Preferably the upwardly inclined portion includes a first cushioning material and the horizontal section includes a second cushioning material, the first cushioning material being denser than the second cushioning material so that when a person sits on the seating apparatus the second cushioning material is compressed and holds the ischial bones and the first cushioning material which is of higher density than the second cushioning material prevents a person from slipping forward on the seating apparatus.

Preferably the inclined support portion also includes a third cushioning material which is of higher density than the second cushioning material.

Preferably the first and third cushioning materials are of the same density.

Preferably the first and third cushioning materials comprise high density foam and the second cushioning material comprises medium density foam.

Preferably the first cushioning material extends to a point above the second cushioning material to provide an abutment surface and preferably the first cushioning material has a top portion located above the second cushioning material.

Preferably a covering cushion material is provided over the first cushioning material and the covering cushioning material extends from the front of the seat portion to the top portion.

Preferably a further covering cushion material is provided over the substantially horizontal portion and the inclined support portion with the further covering cushion material extending from the abutment surface to the rear of the seat portion.

Preferably the seating apparatus includes a seat frame member which includes an upwardly inclined frame section forming part of the upwardly inclined section, a substantially horizontal frame section which forms part of the substantially horizontal section and an inclined support frame section which forms part of the inclined support portion.

Preferably the third cushioning material diverges away from the inclined support frame portion so that it is thicker in a position adjacent to the rear of the seat portion than at a position adjacent the second intermediate position.

Preferably the seating apparatus has a backrest positionable above the seat portion so as to support a person between the second and third lumbar vertebrae when a person is seated on the seating apparatus, the backrest having a support surface which is positioned between the rear of the seat portion and the first intermediate position so that the person's gluteal muscles can extend behind the support surface between the rear of the seat portion and the support surface of the backrest.

The invention in a second aspect may be said to reside in a seating apparatus including:

a seat portion for connection to a base so that the seating apparatus can be supported on the ground, said seat portion having a front and a rear;

said seat portion having;

a) an upwardly inclined portion which inclines upwardly from the front of the seat portion to a first intermediate position between the front and rear of the seat portion;

a support portion extending from the first intermediate portion toward the rear of the seat portion; and a backrest arranged above the seat portion for supporting a person seated on the seat, the backrest having a support surface, the support surface being located between the rear of the seat portion and the first intermediate position so that a person's gluteal muscles can extend between the support surface and the rear of the seat portion, the support surface supporting a person when seated on the seat so that the person's second and third vertebrae are positioned substantially vertically above the person's acetabulum and with the upwardly inclined portion supporting the person's femurs so that the femurs and knees of the person are supported in a position below the person's acetabulum.

The location of the backrest as described above causes the person to be seated in the position previously described with the person's lumbar curve between 30° and 50°, the Ferguson in a male between 30° and 45° and in a female between 23° and 40° and the Ferguson perpendicular postural line measuring either one third anterior or one third posterior of the sacral base.

Preferably the support portion extends from the first intermediate position to a second intermediate position between the first intermediate position and the rear of the seat and preferably an inclined support portion extends between the second intermediate position and the rear of the seat portion.

Preferably the support surface of the backrest is located between the first intermediate position and the second intermediate position.

A preferred embodiment of the invention will be described, by way of example, with reference to the accompanying drawings in which.

Figure 1:
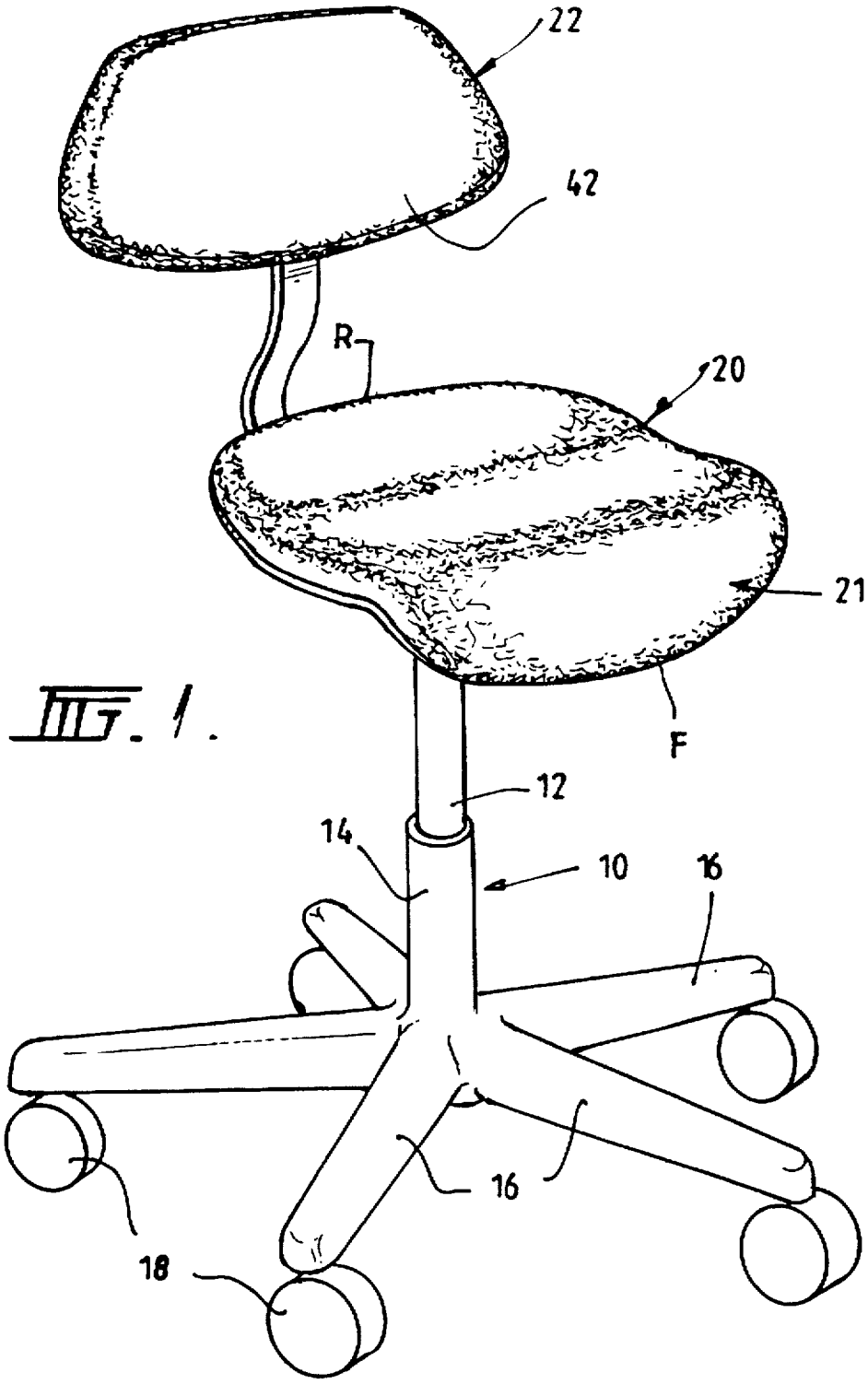
FIG. 1 is a perspective view of a seat embodying the invention.

With reference to the drawings a seat is shown which comprises a base 10 which can be of any desired form. In this embodiment the base comprises an upwardly extending shaft 12 which is adjustable in a sleeve portion 14. The sleeve portion 14 carries a plurality of legs 16 all of which are provided with casters 18 or the like.

The base 10 supports a seat portion 20 and a backrest 22 is also supported by either the seat portion 20 or the base 10. The seat portion 20 has a front F and a rear R.

Figure 2:
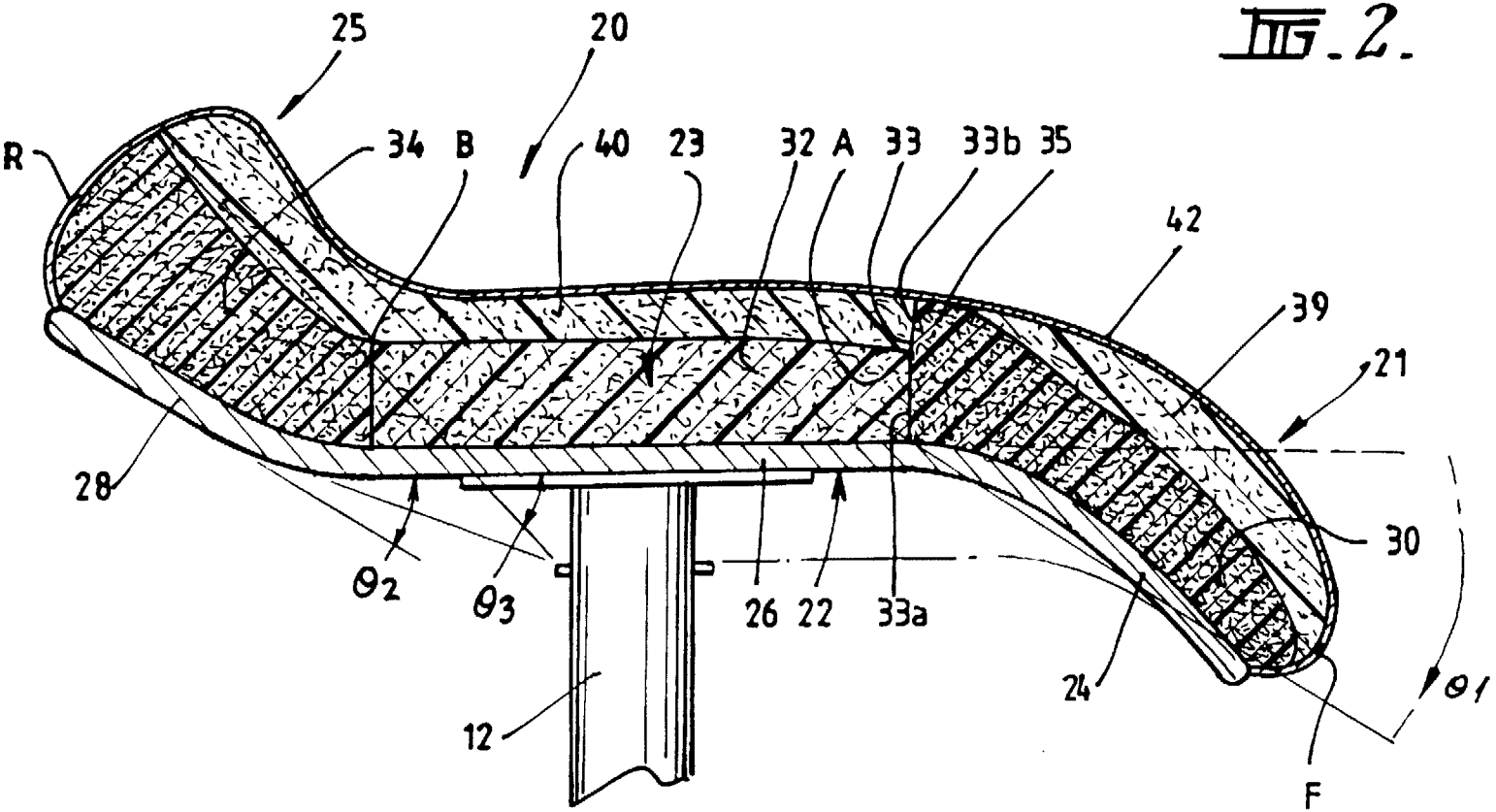
FIG. 2 is cross-sectional view of the seat portion of the seat of FIG. 1.

With reference to FIG. 2, the seat portion 20 includes a seat frame 22 which has an upwardly inclined frame section 24 a substantially horizontal section 26 and an inclined support portion 28. The inclined frame portion 24 is provided with a high density foam cushion 30 which, together with the inclined support frame portion 24 forms an inclined support portion 21 of the seat. The substantially horizontal portion 26 is provided with a medium density foam cushion 32 which, together with the frame portion 26, forms a substantially horizontal portion 23. The inclined support frame portion 28 is provided with a high density cushion 34 which, together with the frame portion 28, forms an inclined support portion 25 of the seat.

The inclined portion formed by the cushion 30 and the frame portion 24 is curved and most preferably forms an angle $\theta_1$ of between 30° and 50° as shown in FIG. 2. It would be possible to form the inclined portion 21 defined by the frame portion 24 and cushion 30 as a straight section at the previously mentioned angle. However, it is preferred that it be slightly curved and that the angle be defined by a line of best fit passing through the inclined portion as is shown in FIG. 2.

The substantially horizontal portion commences at a first intermediate position A and extends to a second intermediate position B and is preferably of a length of between 160 and 180 cms.

The inclined support portion formed by the frame portion 28 and the cushion 34 is arranged at and angle $\theta_2$ of between 30° and 50° with the angle being that which the frame portion 28 makes with respect to the horizontal as is shown in FIG. 2. The cushion 34 is thicker at the second intermediate position B than at the rear R and typically is arranged at an angle $\theta_3$ of approximately 50° to 55° with respect to the horizontal as is shown in FIG. 2.

As clearly shown in FIG. 2, the cushion 30 extends above the cushion 32 to provide an abutment surface 33 and a top portion 35.

A first load density foam covering cushion 39 extends from the front F of the seat portion to the top portion 35 of the cushion 30.

A second low density foam covering cushion 40 is arranged on the seating apparatus and extends from the abutment surface 33 to the rear R of the seat portion. A fabric cover 42 extends over the cushion 40 as is shown.

The cushion 32 abuts and is securely fixed to the lower part 33*a* of the abutment surface 33 of the cushion 30. The covering cushion material 40 abuts and is securely fixed to the upper portion 33*b* of the abutment surface 33 of the cushion 30.

When a person sits on the seat portion, the person's legs are supported in a declined manner by the inclined portion 21. The person's ischial bones are supported by the substantially horizontal portion 23 and because the cushion 32 is of medium density foam compared to the cushion 30, the person will slightly sink into the horizontal portion and in view of the abutment surface 33 and the high density foam cushion 30 the person's ischial bones are prevented from slipping forward on the inclined portion 21. That is, because the cushion 30 is more dense than the cushion 32, the cushion 32 will compress more than the cushion 30 and the abutment surface 33 will effectively form a soft abutment which will prevent a person's ischial bones from sliding forward on the seat portion 20. The upwardly inclined support portion 25 will support the gluteal muscles and the sacroiliac ligaments on the seating apparatus.

The preferred angles and dimensions referred to above support a person so that the angle of the person's lumbar curve is between 30° and 50°, the Ferguson angle in a male is between 30° and 45° and in a female between 23° and 40° and the Ferguson's perpendicular postural line is either one third anterior or one third posterior of the sacral base which produces the most desired physiologically efficient posture and correct biomechanical and organic orientation. In particularly, the seating apparatus of the preferred embodiment encourages reduction in hip flexion and pelvic rotation, thus prevention interruption of the cranial/sacral mechanism by allowing sacral "rocking" to occur. It positions the person as such, that the centre of gravity passes through the acetabulum thus emulating standing posture. A person's feet are positioned flat on the floor.

The backrest 22 includes a lumber support 42 which is positioned so that the lumber support 42 provides support between the second and third lumbar vertebrae when a person is seated. Little or no adjustment of the backrest 22 is required in order to alter the position of the backrest so that the lumbar support 42 will support a person between the second and third lumbar vertebrae regardless of the hight of the person. However, if adjustment is necessary, the backrest 22 can be adjusted upwardly or downwardly relative to the seat portion 20 so that the lumber support is provided between the second and third lumbar vertebrae.

Figure 3:
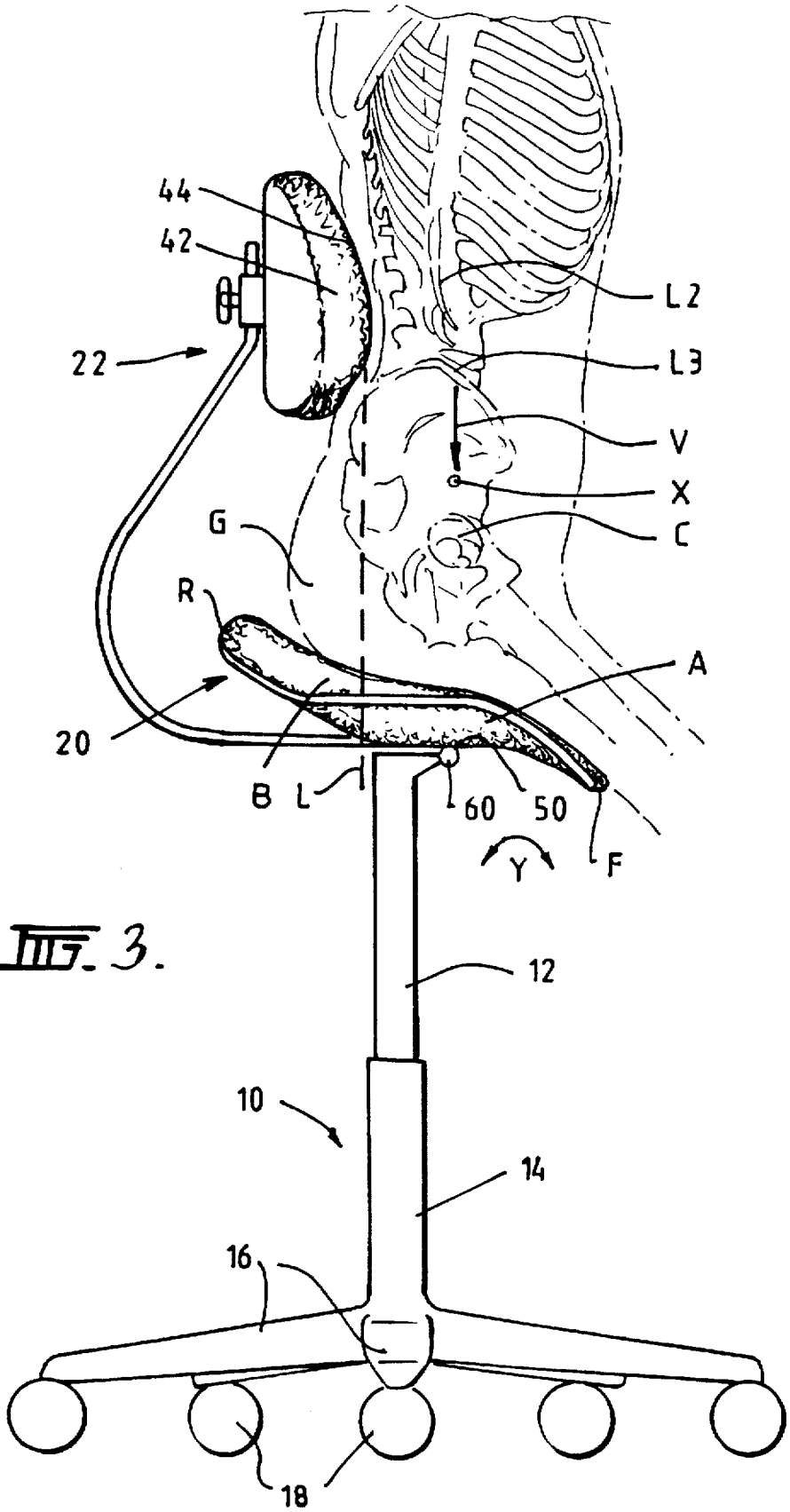
FIG. 3 is a view of a person seated on a seat embodying the invention and detailing back rest positioning.

FIG. 3 shows a side view of the seat of FIGS. 1 and 2 and illustrates a person seated on the seat. As previously described, the backrest 22 includes a lumbar support 42. The lumbar support 42 has a support surface 44 which engages the person's back and supports the person's back between the second and third lumbar vertebrae. As shown by dotted line L, the support surface 44 is positioned between the rear R of the seat 20 (which has the same structure as previously described) and the first intermediate position A. The person's gluteal muscles G are able to extend rearwardly of the support surface 44 between the support surface 44 and the rear R of the seat so that the person's second and third vertebrae are positioned substantially vertically above the person's acetabulum C as shown by the arrow V in FIG. 3.

By locating the backrest in the position described above, the inclined support portion 25 could be omitted and replaced by a substantially flat portion or merely an extension of the horizontal portion 23 and the person will still be held in the position referred to above in correct biomechanical and organic orientation. Of course, the inclined support portion 25 is most preferred because it does provide additional support to the gluteal muscles for added comfort.

Most preferably the support surface 44 is positioned between the first intermediate position A and the second intermediate position B of the seat portion. In the embodiments shown in FIG. 3, the seat portion includes an adjustment section 50 which supports the seat portion 20 and provides for adjustment of the seat portion 20 upwardly and downwardly and also angularly with respect to the horizontal. Such adjustment mechanisms are conventional and therefore will not be described in detail herein.

Thus, with the seat of the preferred embodiment the person's sacrum, pelvis, spinal column and cranium are maintained in correct biomechanical and organic orientation so that the nervous system and primary respiratory system are not impaired by incorrect seating posture and will function to their full potential and at peak efficiency.

As shown in FIG. 3, the seat portion 20 is pivotally connected at 60 to the support base 10. The pivotal connection is a conventional pivotal connection used to pivot seats and therefore full structural details need not be disclosed. The important feature of the preferred embodiment of the invention is the location of the pivot relative to the seat 20 and the person sitting on the seat 20. The pivot 60 is most preferably located generally centrally of the substantially horizontal portion 23 of the seat and directly below a person's centre of gravity X when seated on the seat. The pivotal connection 60 enables the seat to pivot back and forward generally in the direction of arrow Y in FIG. 3.

Since modifications within the spirit and scope of the invention may readily be effected by persons skilled within the art, it is to be understood that this invention is not limited to the particular embodiment described by way of example hereinabove.

I claim:

1. A seating apparatus including:

a seat portion for connection to a base so that the seating apparatus can be supported on the ground, said seat portion having a front and a rear;

said seat portion having (a) an upwardly inclined portion which inclines upwardly from the front of the seat portion to a first intermediate position between the front and rear of the seat portion;

(b) an inclined support portion extending between a second intermediate position and the rear of the seat portion;

(c) a substantially flat horizontal portion extending from the first intermediate position to the second intermediate position;

(d) the inclined support portion being inclined at an angle of between 30° to 50° with respect to the substantially flat horizontal portion;

wherein the upwardly inclined portion is for supporting the femurs of a person so that the femurs and knees are supported in a position below the person's acetabulum, said substantially flat horizontal portion being for receiving and holding the ischial bones when the person sits down and said inclined support portion being for supporting the person's gluteal muscles and sacra-iliac ligaments;

the upwardly inclined portion including a first cushioning material;

the flat horizontal portion including a second cushioning material; and the first cushioning material being denser than the second cushioning material so that when a person sits on the seating apparatus the second cushioning material is compressed and holds the ischial bones and the first cushioning material which is of higher density than the second cushioning material prevents a person from slipping forward on the seating apparatus.

2. The seating apparatus of claim 1 wherein the upwardly inclined portion is inclined at an angle of between 30° and 50° with respect to the horizontal, and the substantially horizontal section has a length of between 160 and 180 mms.

3. The seating apparatus of claim 1 wherein a further covering cushion material is provided over the substantially horizontal portion and the inclined support portion with the further covering cushion material extending from the abutment surface to the rear of the seat portion.

4. The seating apparatus of claim 1 wherein the seating apparatus includes a seat frame member which includes an upwardly inclined frame section forming part of the upwardly inclined section, a substantially horizontal frame section which forms part of the substantially horizontal section and an inclined support frame section which forms part of the inclined support portion.

5. The seating apparatus of claim 1 wherein the third cushioning material diverges away from the inclined support frame portion so that it is thicker in a position adjacent to the rear of the seat portion than at a position adjacent the second intermediate position.

6. The seating apparatus of claim 1 wherein the seating apparatus has a backrest positionable above the seat portion so as to support a person between the second and third lumbar vertebrae when a person is seated on the seating apparatus, the backrest having a support surface which is positioned between the rear of the seat portion and the first intermediate position so that the person's gluteal muscles can extend behind the support surface between the rear of the seat portion and the support surface of the backrest.

7. The seating apparatus of claim 1 wherein the inclined support portion also includes a third cushioning material which is of higher density than the second cushioning material.

8. The seating apparatus of claim 7 wherein the first and third cushioning materials are of the same density.

9. The seating apparatus of claim 8 wherein the first and third cushioning materials comprise high density foam and the second cushioning material comprises medium density foam.

10. The seating apparatus of claim 1 wherein the first cushioning material extends to a point above the second cushioning material to provide an abutment surface and the first cushioning material has a top portion located above the second cushioning material.

11. The seating apparatus of claim 1 wherein a covering cushion material is provided over the first cushioning material and the covering cushioning material extends from the front of the seat portion to the top portion.

12. A seating apparatus including:

a seat portion for connection to a base so that the seating apparatus can be supported on the ground, said seat portion having a front and a rear;

said seat portion having (a) an upwardly inclined portion which inclines upwardly from the front of the seat portion to a first intermediate portion between the front and rear of the seat portion, the upwardly inclined portion having a first cushioning material;

(b) a substantially horizontal portion extending from the first intermediate position to a second intermediate position, the horizontal portion having a second cushioning material; and (c) an inclined support portion extending between the second intermediate position and the rear of the seat portion;

(d) a support frame member supporting the upwardly inclined portion, the horizontal flat portion and the inclined support portion, the support frame member having an inclined support frame portion;

wherein the upwardly inclined portion is for supporting the femurs of a person so that the femurs and knees are supported in a position below the person's acetabulum, said substantially horizontal portion being for receiving and holding the ischial bones when the person sits down and said inclined support portion being for supporting the person's gluteal muscles and sacra-iliac ligaments, the inclined support portion also including a third cushioning material which is of higher density than the second cushioning material, the third cushioning material diverging away from the inclined support frame portion so that it is thicker, in a direction perpendicular to a longitudinal axis of the inclined support portion in a position adjacent to the end of the inclined support portion than at a position adjacent the second intermediate position.

13. The seating apparatus of claim 12, wherein the upwardly inclined portion is inclined at an angle of between 30° and 50° with respect to the horizontal, the substantially horizontal section has a length of between 160 and 180 mms and the inclined support portion is inclined at an angle between 30° and 50° to the horizontal.

14. The seating apparatus of claim 13, wherein the first cushioning material extends to a point above the second cushioning material to provide an abutment surface and the first cushioning material has a top portion located above the second cushioning material.

15. The seating apparatus of claim 13, wherein a covering cushion material is provided over the first cushioning material and the covering cushioning material extends from the front of the seat portion to the top portion.

16. The seating apparatus of claim 15, wherein a further covering cushion material is provided over the substantially horizontal portion and the inclined support portion with the further covering cushion material extending from the abutment surface to the rear of the seat portion.

17. The seating apparatus of claim 12, wherein the upwardly inclined portion includes a first cushioning material and the horizontal section includes a second cushioning material, the first cushioning material being denser than the second cushioning material so that when a person sits on the seating apparatus the second cushioning material is compressed and holds the ischial bones and the first cushioning material which is of higher density than the second cushioning material prevents a person from slipping forward on the seating apparatus.

18. The seating apparatus of claim 12, wherein the first and third cushioning materials are of the same density.

19. The seating apparatus of claim 18, wherein the first and third cushioning materials comprise high density foam and the second cushioning material comprises medium density foam.

20. The seating apparatus of claim 12, wherein the seating apparatus includes a seat frame member which includes an upwardly inclined frame section forming part of the upwardly inclined section, a substantially horizontal frame section which forms part of the substantially horizontal section and an inclined support frame section which forms part of the inclined support portion.

21. The seating apparatus of claim 12, wherein the seating apparatus has a backrest positionable above the seat portion so as to support a person between the second and third lumbar vertebrae when a person is seated on the seating apparatus, the backrest having a support surface which is positioned between the rear of the seat portion and the first intermediate position so that the person's gluteal muscles can extend behind the support surface between the rear of the seat portion and the support surface of the backrest.

22. A seating apparatus including:

a seat portion for connection to a base so that the seating apparatus can be supported on the ground, said seat portion having a front and a rear;

said seat portion having (a) an upwardly inclined portion which inclines upwardly from the front of the seat portion to a first intermediate position between the front and rear of the seat portion;

(b) an inclined support portion extending between a second intermediate position and the rear of the seat portion;

(c) a substantially horizontal portion between the first intermediate position to the second intermediate position;

wherein the upwardly inclined portion is for supporting the femurs of a person so that the femurs and knees are supported in a position below the person's acetabulum, said substantially horizontal portion being for receiving and holding the ischial bones when the person sits down and said inclined support portion being for supporting the person's gluteal muscles and sacra-iliac ligaments;

the upwardly inclined portion including a first cushioning material;

the horizontal portion including a second cushioning material; and the first cushioning material being denser than the second cushioning material so that when a person sits on the seating apparatus the second cushioning material is compressed and holds the ischial bones and the first cushioning material which is of higher density than the second cushioning material prevents a person from slipping forward on the seating apparatus, the inclined support portion also including a third cushioning material which is of higher density than the second cushioning material.

23. The seating apparatus of claim 22, wherein the first and third cushioning materials are of the same density.

24. The seating apparatus of claim 23, wherein the first and third cushioning materials comprise high density foam and the second cushioning material comprises medium density foam.

25. The seating apparatus of claim 22, wherein the first cushioning material extends to a point above the second cushioning material to provide an abutment surface and the first cushioning material has a top portion located above the second cushioning material.

26. The seating apparatus of claim 22, wherein a covering cushion material is provided over the first cushioning material and the covering cushioning material extends from the front of the seat portion to the top portion.

27. The seating apparatus including:

a seat portion for connection to a base so that the seating apparatus can be supported on the ground, said seat portion having a front and a rear;

said seat portion having (a) an upwardly inclined portion which inclines upwardly from the front of the seat portion to a first intermediate position between the front and rear of the seat portion;

(b) an inclined support portion extending between a second intermediate position and the rear of the seat portion;

(c) a substantially flat horizontal portion extending from the first intermediate position to the second intermediate position;

wherein the upwardly inclined portion is for supporting the femurs of a person so that the femurs and knees are supported in a position below the person's acetabulum, said substantially flat horizontal portion being for receiving and holding the ischial bones when the person sits down and said inclined support portion being for supporting the person's gluteal muscles and sacra-iliac ligaments;

the upwardly inclined portion including a first cushioning material;

the flat horizontal portion including a second cushioning material; and the first cushioning material being denser than the second cushioning material so that when a person sits on the seating apparatus the second cushioning material is compressed and holds the ischial bones and the first cushioning material which is of higher density than the second cushioning material prevents a person from slipping forward on the seating apparatus;

the inclined support portion including a third cushioning material, said third cushioning material being of a higher density than said second cushioning material.

28. The seating apparatus of claim 27 wherein the first and third cushioning materials are of the same density.

29. The seating apparatus of claim 28 wherein the first and third cushioning materials comprise high density foam and the second cushioning material comprises medium density foam.

* * * * *